US005449095A

United States Patent [19]

Kobayashi

[11] Patent Number: 5,449,095

[45] Date of Patent: Sep. 12, 1995

[54] TONER KIT

[75] Inventor: Hiroyuki Kobayashi, Yokohama, Japan

[73] Assignee: Canon Kabushiki Kaisha, Tokyo, Japan

[21] Appl. No.: 348,141

[22] Filed: Nov. 23, 1994

Related U.S. Application Data

[63] Continuation of Ser. No. 181,479, Jan. 14, 1994, abandoned, which is a continuation of Ser. No. 911,794, Jul. 10, 1992, abandoned, which is a continuation of Ser. No. 539,341, Jun. 18, 1990, abandoned.

[30] Foreign Application Priority Data

Jun. 19, 1989 [JP] Japan ..... 1-154721

[51] Int. Cl.[6] ..... B65D 88/54

[52] U.S. Cl. ..... 222/325; 222/564; 222/DIG. 1

[58] Field of Search ..... 222/325, 561, 564, DIG. 1

[56] References Cited

U.S. PATENT DOCUMENTS

| | | | |
|---|---|---|---|
| 4,456,154 | 6/1984 | Herriman | 222/325 |
| 4,589,579 | 5/1986 | Morita | 222/561 |
| 4,592,987 | 6/1986 | Mitsuhashi et al. | 222/DIG. 1 |
| 4,828,956 | 5/1989 | Creatura et al. | 222/DIG. 1 |
| 4,930,684 | 6/1990 | Patterson | 222/DIG. 1 |
| 4,961,450 | 10/1990 | Furuta | 222/DIG. 1 |
| 5,040,024 | 8/1991 | Fukada et al. | 222/DIG. 1 X |

FOREIGN PATENT DOCUMENTS

| | | | |
|---|---|---|---|
| 0032986A2 | 8/1981 | European Pat. Off. . | |
| 0101303A3 | 2/1984 | European Pat. Off. | 222/325 |
| 225865 | 4/1969 | Sweden | 222/564 |

*Primary Examiner*—Andres Kashnikow
*Assistant Examiner*—Joseph A. Kaufman
*Attorney, Agent, or Firm*—Fitzpatrick, Cella, Harper & Scinto

[57] ABSTRACT

A toner kit includes a toner for developing electrostatic images and a toner container. The toner has a flowability index of from 5 to 25% and the toner container is provided at a discharge opening thereof with a flow control edge at least part of which has a slope with a slope angle $\theta$of from 110° to 160° with respect to the plane of the discharge opening.

24 Claims, 4 Drawing Sheets

TONER KIT

This application is a continuation of application Ser. No. 08/181,479 filed Jan. 14, 1994, which is a continuation of application Ser. No. 07/911,794 filed Jul. 10, 1992, which is a continuation of application Ser. No. 07/539,341 filed Jun. 18, 1990, all now abandoned.

BACKGROUND OF THE INVENTION

1. Field of the Invention

The present invention relates to a toner kit in which a toner used in an image forming process, such as electrophotography, is held in a container. The toner kit of the present invention enables rapid discharge of the toner from the container, and also reduces the quantity of a toner that may remain in the container. Hence, the toner can be rapidly fed to an image forming apparatus, such as a copying machine, and also toner loss can be decreased.

2. Related Background Art

Toners used in electrophotography and containers for holding the toners have been often developed and studied in respectively separate researchers. For this reason, research sections for developing toners have so far devoted their efforts to improving various toner characteristics in electrophotography, but they have not focused on pursing its stability in and dischargeability; from, a toner container.

On the other hand, research sections in charge of toner containers have paid much attention to readiness in handling the containers in physical distribution, cost reduction, and designing.

For example, a toner container manufactured by taking into account only charging quantity of a toner can received therein by 90% or more of the toner with respect to its inner volume. Since, it is difficult to make the container hold a toner in a quantity of 100% of its inner volume, there remains a small unfilled space in the container. Because of this space, the toner can move in the container, but tends to agglomerate or gather to one side during storage or in the course of transportation. This tendency is remarkable in a toner with a poor flowability. In order to prevent the toner from agglomeration or other undesirable phenomena, it is required to shake a container several times when used. However, even when a container has been shaken, blocking tends to occur in the vicinity of an opening of the container. Even with use of a container with increased flatness in its inner wall so as to secure smooth discharge of the toners, the desired results can not be expected.

In another example, for the purpose only of lowering the cost for packaging without taking into account the toner characteristics, a toner is filled in an amount as large as possible for the volume of a container and an opening of the container is made as small as possible. However, an attempt to make the opening smaller tends to cause an undesirable result that the toner remains in the container in a greater proportion. In order to eliminate these problems, one may contemplate that the flowability of a toner is increased so that the discharge performance of the toner can be improved. On the contrary, when the flowability of a toner is increased, a negative result sometimes occurs such that the charge characteristics of the toner is lowered or the scattering of the toner particles within a copying machine becomes remarkably increased.

Reproductions obtained by electrophotography are required to have a high resolution, have no blurred or thickened character image or fine-line image of documents or drawings, have a high density, have a good gradation at solid areas, and are free from image stain (so-called fog) in the white areas.

Under such circumstances, it has been studied in recent years to make the average particle diameter of a toner smaller for the purpose of improving the resolution. In usual instances, the finer the average particle diameter of a toner is made, the lower the flowability of a toner becomes. This tends to result in an inhibition of rapid triboelectric charging between a toner and a carrier, cause fog or spots around image, and brings about a lowering of transfer rate or cleaning properties.

When a copy is taken with an electrophotographic copying apparatus, using a toner having a small particle diameter, a good toner image with a high resolution can be obtained at the initial stage, but an edge effect that brings about an emphasized outline of a toner image may occur after copying on several ten thousand sheets of paper, tending to lower gradation, sharpness, and solid-area uniformity. Particularly under conditions of a high humidity, toner images tend to provide a poor toner image with conspicuous fog and spots around the images. Moreover, it is not preferable that the inside of a machine is contaminated because of the scattering of a toner insufficiently charged. In particular, the above phenomenon is remarkable in the full-color copying that requires a large toner consumption.

This occurs because the toner has such poor flowability that no rapid triboelectric charging takes place between a fed toner and a carrier contained in a developer, so that a toner with insufficient triboelectric charges or a toner with non-uniform charges is brought about and these toners participate in development.

The poorness in flowability of a toner may cause agglomeration of a fed toner in a feed hopper or feed pipe. This not only may obstruct smooth transport of the toner and smooth feed of the toner, but also raises the possibility that a conveyor screw in the feed pipe may be broken because of the blocking of the toner.

As methods used for the purpose of eliminating such difficulties caused by toners, there is a method in which fine particles of an oxide such as silicon oxide, titanium oxide or aluminum oxide are mixed in a toner as a flowability improver. When any of these oxides is mixed in a toner, the flowability of the toner is certainly improved, compared with an instance in which none of them is added. If, however, the oxide is merely mixed in a toner, the flowability of the toner can not be sufficiently improved, sometimes causing the difficulties as stated above.

This occurs presumably because the flowability improver is not uniformly imparted to particle surfaces of the toner.

When the toner to which no flowability improver is not uniformly imparted is used, the toner and the flowability improver gradually form a filmy thin coating because of an external force produced by a means such as a cleaning blade, bringing about a filming phenomenon.

If the flowability improver is insufficiently dispersed, the flowability improver is not uniformly strongly adhered to toner particle surfaces, so that liberated flowability improver or an agglomerate of the flowability improver is electrostatically adhered to the surface of a photosensitive member. As a result, a film is formed on the photosensitive member by an external force to affect the development.

SUMMARY OF THE INVENTION

An object of the present invention is to provide a novel toner kit that can eliminate the above problems.

Another object of the present invention is to provide a toner kit in which a toner with a small flowability index is held in a toner container having a flow control edge and which is capable of achieving superior toner discharge performance.

The present invention provides a toner kit comprising a toner for developing electrostatic images and a toner container, wherein said toner has a flowability index of from 5 to 25% and said toner container is provided at a discharge opening thereof with a flow control edge at least part of which has a slope with a slope angle $\theta$ of from 110° to 160° with respect to the plane of the discharge opening. The toner member further includes a fitting member for fitting the shutter member to a body of the toner container and a sealing member for sealing a joint provided at a position between the shutter member and the body of the toner container. The sealing member is retained at the position to maintain a sealed joint even during the flow of the toner.

BRIEF DESCRIPTION OF THE DRAWINGS

In the accompanying drawings.

DETAILED DESCRIPTION OF THE PREFERRED EMBODIMENTS

The flowability index of a toner refers to an index showing how uniformly and strongly a flowability improver is adhered to toner particle surfaces when a flowability improver has been added to a toner containing at least a resin and a coloring agent and having a volume average particle diameter of from 5 to 10 μm. The smaller the numerical values of the flowability index are, the more uniformly and strongly the flowability improver is adhered and the flowability is improved. The flowability of a toner can be improved when the flowability index is controlled to be from 5 to 25%, and preferably from 10 to 23%, so that the triboelectric charging between toner and carrier rapidly takes place. Hence, there occurs no fog that may be caused by a toner non-uniformly charged or a toner with insufficient charges, there occurs no flying of toner, an image at a solid area can be uniform, a sharp toner image can be obtained, and continuous copying may cause less image deterioration. Moreover, a good transfer rate can be achieved, a high image density can be obtained, cleaning properties are so good that no image stain caused by defective cleaning may occur, and also smooth transport and feeding of toner can be assured. The filming to a photosensitive member that may be caused by the flowability improver can be prevented because of strong adhesion of the flowability improver to toner particles.

Thus, in view of the discharge performance required when a toner is discharged from a toner container and the development performance required when a toner is used in an electrophotographic copying machine, it is important to set the flowability index to be from 5 to 25% in respect of a toner having a volume average particle diameter of from 5 to 10 μm, and preferably from 6 to 9 μm.

When the toner with a flowability index of from 5 to 25% is held in a toner container provided with a flow control edge at its discharge opening, the toner may be spouted and discharged straight to the outside of a toner container, depending on the structure of the toner container, in particular, the structure of flow control edges, so that an electrophotographic copying machine connected to the container may be contaminated with the toner or the toner may scatter inside the machine. In another type of structure of flow control edges, the toner tends on the other hand, to stagnate inside the container and it may sometimes occur that the toner stops flowing in the container before even a half of the toner contained therein is discharged, and can not be discharged even if the container is shaken.

Figure 1:
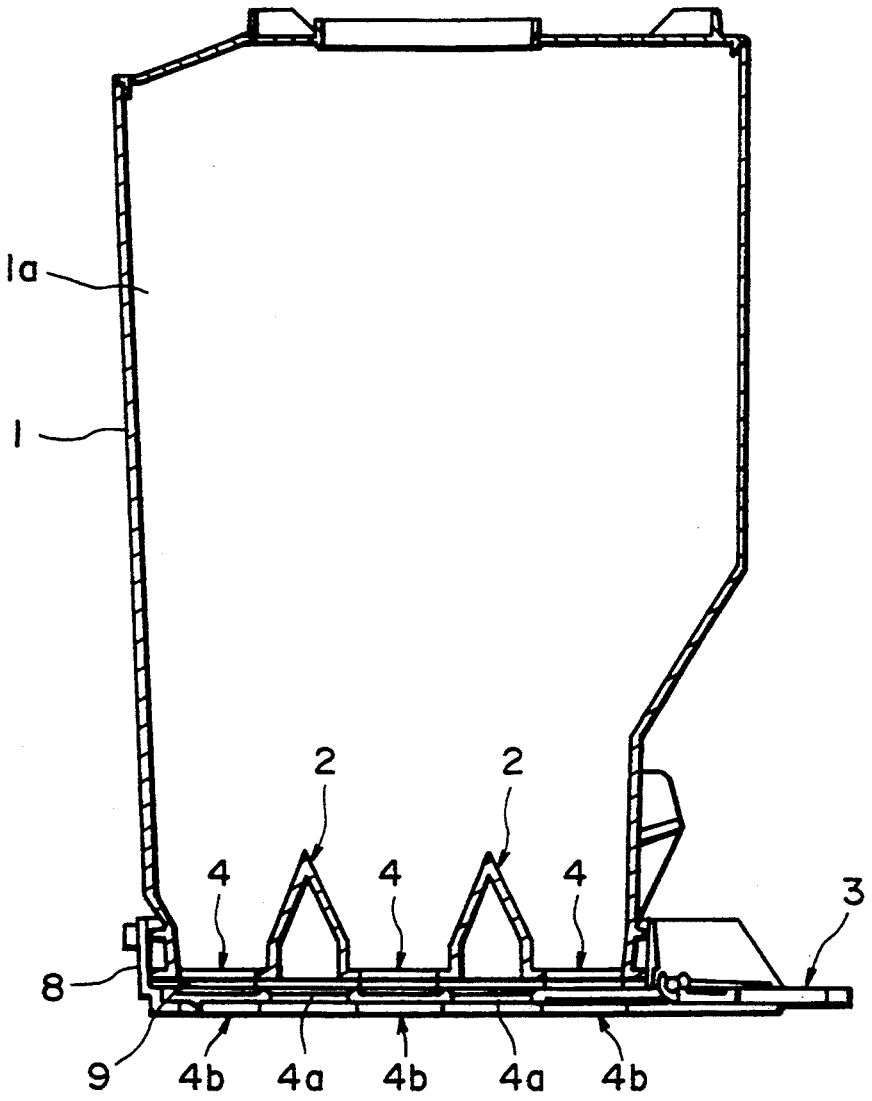
FIG. 1 schematically illustrates a cross section of an example of a toner container used in the toner kit of the present invention.
Figure 2A:
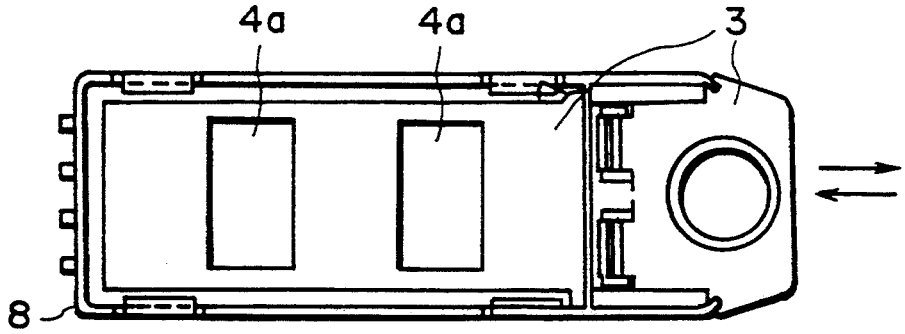
FIG. 2A schematically illustrates the top of a fitting member having a shutter member, and FIG. 2B schematically illustrates the back of the fitting member.
Figure 2B:
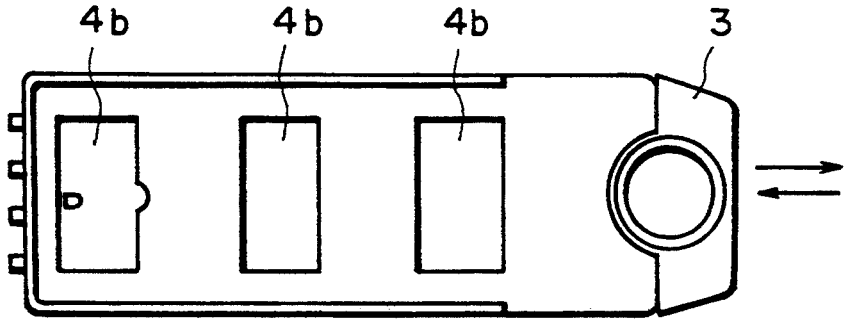

As an example for the toner kit of the present invention, FIGS. 1, 2A, 2B and illustrate cross sections of a toner container having the structure that can sufficiently exhibit the meritorious effects of the present invention, and external views of discharge openings. The toner container comprises a body 1 having space 1*a* in which a toner is held, and a discharge opening 4 from which the toner is discharged.

The toner container is provided with a plurality of flow control edges 2 (two edges in FIG. 1) connected to a discharge opening member 5 having the discharge openings 4. It is also provided at a lower part of the discharge opening member 5 with a fitting member 8 for fitting a shutter member 3 slidably inserted and having an opening 4*a* so that the discharge opening 4 can be controlled to be opened or closed.

In FIG. 1, the body 1 and the discharge opening member 5 are integrally formed, and the shaded part thereof may preferably be made of a styrene resin. The shutter member 3 may preferably be made of an acrylonitrile-butadiene-styrene copolymer (ABS resin) or an acrylonitrile-styrene copolymer (AS resin). The fitting member 8 equipped with the shutter member 3 may preferably be made of a polypropylene resin. It is preferred for the fitting member 8 to be equipped with a sealing member 9 formed of an elastic material such as a polyurethane so that the close contact between the fitting member 8 and the discharge opening member 5 can be enhanced. The sealing member 9 seals a joint provided at a position between the shutter member 3 and the body of the toner container. The shutter member 3*a* is pulled to the right and thus the discharge opening 4 and the opening 4*a* and another discharge opening 4 and an opening 4*b* made in a bottom plate of the discharge opening member 5, respectively, are communicated through each other, so that the toner inside the body 1 is discharged.

The toner container may preferably be filled with toner by not more than 80%, and more preferably not more than 70%, and still more preferably from 50 to 65%, of the capacity defined by the space 1*a* in which the toner is held. A fill of more than 80% results in a great decrease in the space through which the toner can move, so that the toner tends to undergo bridging even if it has a low flowability index, and, in many instances, it becomes difficult for the toner to be discharged in its entirety if the toner container is rollingly shaken upward and downward only several times.

Figure 3:
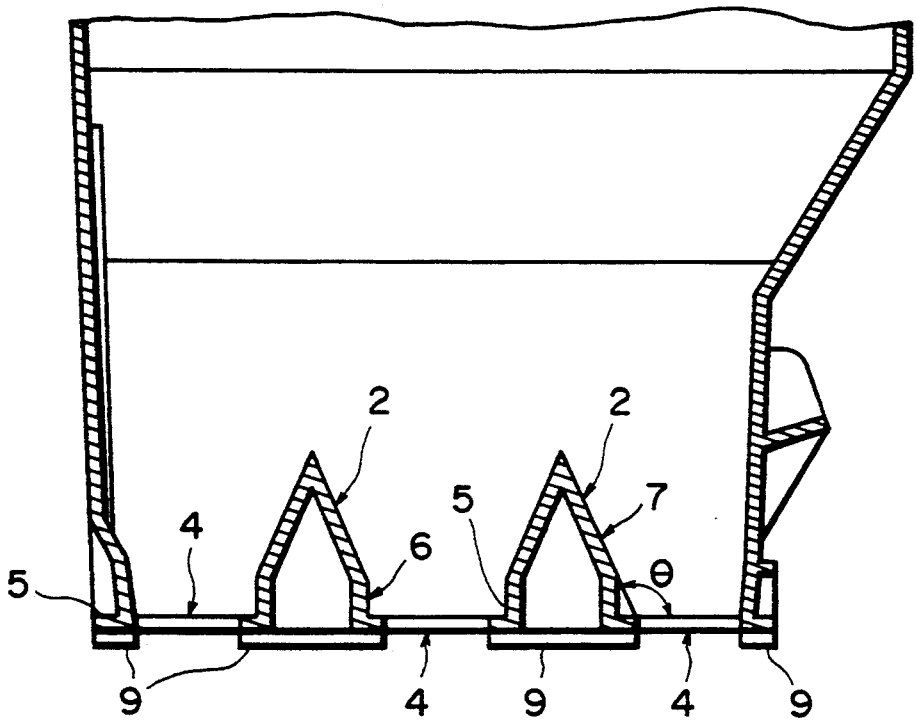
FIG. 3 is a sectional enlarged view of discharge openings of a toner container and the vicinity of the discharge openings.
Figure 4:
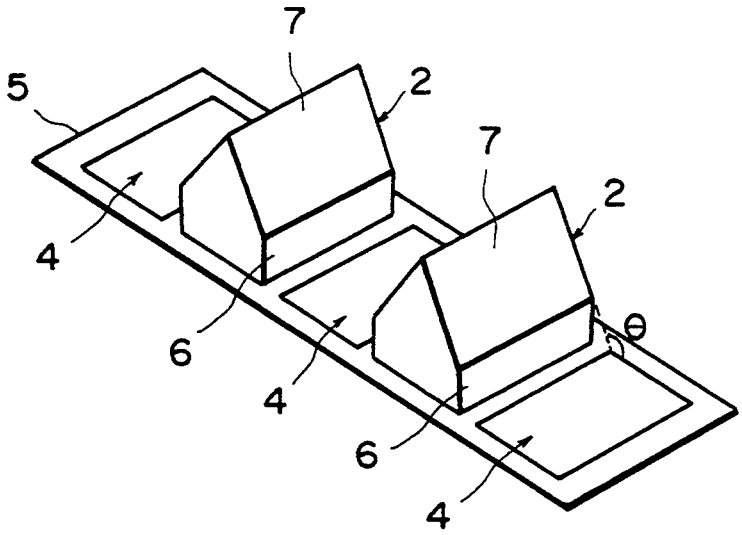
FIGS. 4 and 5 are perspective views to illustrate forms of flow control edges.
Figure 5:
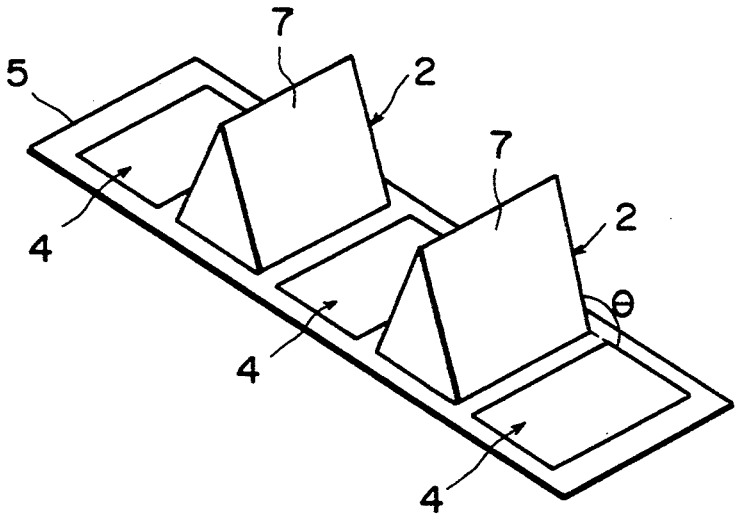

FIG. 3 is an enlarged view of the part of the flow control edges shown in FIG. 1. FIGS. 4 and 5 are perspective views of the part of the flow control edges shown in FIG. 1.

The flow control edges 2 play an important roll to control the discharging of a toner. Their appropriate construction, form and number depend upon the powder characteristics of the toner to be held in the container.

In the case of the toner having a small flowability index and capable of very readily flowing as intended in the present invention, the construction of a flow control edge greatly influences the discharge performance of the toner.

FIGS. 4 and 5 show examples of the construction of the flow control edge according to the present invention. The flow control edge 2 shown in FIG. 4 has a wall surface 6 rising at an angle of 90° with respect to the discharge opening member 5, and has a slope 7 connecting at the top of the wall surface 6. The angle formed here between the slope 7 15 of the flow control edge 2 and the plane of the discharge opening of the discharge opening member 5 is represented by a slope angle $\theta$.

The slope angle $\theta$ is applicable in the range of from 110° to 160°, and preferably from 110° to 150°.

If the angle is less than 110°, the toner is discharged straight to the outside of the container because of a good flowability of the toner when the discharge opening 4 is opened by the shutter member 3. For example, when a toner held in the container is transferred to another container or when a toner is fed to an electrophotographic copying machine, the toner may be spouted, making it impossible to properly control the flow of the toner. Hence, the toner can not be successfully introduced into another container or into the copying apparatus, causing the scattering of toner around another container or the copying machine, the air pollution due to toner dust, and the contamination of hands, fingers and clothes of operators.

If the angle is more than 160°, the toner may be discharged at an appropriate flow velocity at the initial stage because of a low toner discharge effect. The flow velocity, however, is gradually lowered, so that the toner can not be discharged in its entirety at the final stage and tends to remain in the container. When the $\theta$ is more than 160°, the toner may remain, in an extreme instance, at a rate reaching about a half of the quantity of the toner initially held in the container.

In the present invention, it is also possible to use a flow control edge having the form as shown in FIG. 5. A slope 7 of the flow control edge shown in FIG. 5 has no wall surface 6, and hence the angle $\theta$ formed in relation to the discharge opening member 5 may be made larger than that in the embodiment shown in FIG. 4.

The flow control edge 2 can bring about better results when it is provided in a large number depending on the correlation with the area of the opening.

In the toner container according to the present invention, the flow control edge 2 may preferably have a length of from 30 to 60 mm, a height of from 10 to 40 mm (preferably from 20 to 30 mm), and a width of from 10 to 25 mm (preferably from 15 to 20 mm). The toner container may preferably have a plurality of discharge openings each having an area of from $5\times A/100$ to $20\times A/100$, and preferably from $10\times A/100$ to $15\times A/100$, based on the area A ($mm^2$) of the discharge opening member 5.

In order to obtain the toner according to the present invention, having a flowability index of from 5 to 25%, the four factors of i) a toner having a volume average particle diameter of from 5 to 10 $\mu$m, preferably from 6 to 9 $\mu$m, ii) a kind and amount of a flowability improver, iii) a type of a mixing machine, and iv) conditions under which the toner and the flowability improver are mixed may be appropriately combined. The stated flowability index can be thus achieved.

As the mixing machine, it is possible to use an apparatus as exemplified by a rotary blender, a container drum mixer, a tumbling mixer, a V-type blender, a double-corn blender, a ribbon blender, a paddle blender, a vertical ribbon blender, a Nauter mixer, Henschel mixer, a microspeed mixer, and a flow-jet mixer.

The flowability improver includes fluorine resin powders such as vinylidene fluoride fine powder, and polytetrafluoroethylene fine powder; fatty acid metal salts such as zinc stearate, calcium stearate, and lead stearate; metal oxides such as zinc oxide powder; silica fine powders such as silica produced by the wet process, silica produced by the dry process, and treated silica obtained by applying a surface treatment to the above silica with a treating agent such as a silane coupling agent, a titanium coupling agent or a silicone oil.

A preferred flowability improver is a silica fine powder produced by vapor phase oxidation of a silicon halide, i.e., a silica called dry-process silica or fumed silica. For example, it is produced by utilizing thermal decomposition oxidation of silicon tetrachloride gas in oxyhydrogen flame. A basic reaction scheme thereof is shown below.

$$SiCl_4+2H_2O+O_2\rightarrow SiO_2+4HCl$$

In this production process, it is also possible to obtain a composite fine powder comprised of silica and a different metal oxide, using, for example, a different metal halide such as aluminum chloride or titanium chloride in combination with a silicon halide. In the present invention, the silica includes the products thus prepared.

The silica may preferably have a particle diameter in the range of from 0.001 to 2 $\mu$m, more preferably from 0.002 to 0.2 $\mu$m, and particularly preferably from 0.003 to 0.1 $\mu$m, in terms of an average primary particle diameter. A silica fine powder having a particle diameter within such a range should be used.

Commercially available silica fine powders produced by vapor phase oxidation of a silicon halide include, for example, those on the market under the following trade names.

AEROSIL 130, 200, 300, 380, TT600, MOX170, MOX80, COK84 (products of Nippon Aerosil Co., Ltd.).

Ca-O-SIL M-5, MS-7, MS-75, HS-5, EH-5 (products of Cabot Co.).

Wacker HDK N20, V15, N20E, T30, T40 (products of Wacker-Chemie Gmbh).

D-C Fine Silica (a product of Dow-Corning Corp.).

Fransol (a product of Fransil Co.).

It is further preferred to use a treated silica fine powder obtained by applying a hydrophobic treatment to the above silica fine powder produced by vapor phase oxidation of a silicon halide. In this treated silica fine powder, particularly preferred is a product obtained by treating the silica fine powder so as to give a hydrophobicity in the range of from 30 to 80 as measured by ethanol titration.

A method for making the silica fine powder hydrophobic includes a method in which it is treated with an organic silicon compound capable of reacting with, or being physically adsorbed on, the silica fine powder.

A preferred method includes a method in which the silica fine powder produced by vapor phase oxidation of a silicon halide is treated with an organic silicon compound.

Examples of such an organic silicon compound are hexamethyldisilazane, trimethylsilane, timethylchlorosilane, timethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in the units positioned at the terminals. These may be used alone or as a mixture of two or more kinds.

The treated silica fine powder to be used may preferably have a particle diameter in the range of from 0.003 to 0.1 μm. Commercially available products include Taranox-500 (a product of Tarco Co.) and AEROSIL R-972 (a product of Nippon Aerosil Co., Ltd.).

If necessary, the above flowability improver may be previously disintegrated using a pulverizer, and thereafter mixed and dispersed in a toner by means of a mixing machine such as a Henschel mixer.

A binder resin to be used in the toner includes homopolymers of styrene and derivatives thereof, such as polystyrene, poly-p-chlorostyrene, and polyvinyltoluene; styrene copolymers such as a styrene/p-chlorostyrene copolymer, a styrene/propylene copolymer, a styrene/vinyltoluene copolymer, a styrene/vinylnaphthalene copolymer, a styrene/methyl acrylate copolymer, a styrene/ethyl acrylate copolymer, a styrene/butyl acrylate copolymer, a styrene/octyl acrylate copolymer, a styrene/methyl methacrylate copolymer, a styrene/ethyl methacrylate copolymer, a styrene/butyl methacrylate copolymer, a styrene/α-chloromethyl methacrylate copolymer, a styrene/acrylonitrile copolymer, a styrene/vinyl methyl ether copolymer, a styrene/ethyl vinyl ether copolymer, a styrene/methyl vinyl ketone copolymer, a styrene/butadiene copolymer, a styrene/isoprene copolymer, a styrene/acrylonitrile/indene copolymer, a styrene/maleic acid copolymer, and a styrene/maleate copolymer; polymethyl methacrylate, polybutyl methacrylate, polyvinyl chloride, polyvinyl acetate, polyethylene, polypropylene, polyesters, polyurethanes, polyamides, epoxy resins, polyvinyl butyral, polyacrylate resins, rosin, modified rosin, terpene resins, phenol resins, aliphatic or alicyclic hydrocarbon resins, aromatic petroleum resins, chlorinated paraffin, and paraffin wax. These may be used alone or in the form of a mixture.

Particularly preferred resins include styreneacrylate resins, and polyester resins.

In particular, the following is preferred because of its sharp melt characteristics: A polyester resin obtained by copolymerizing a bisphenol derivative represented by the formula:

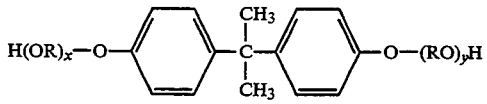

wherein R is an ethylene or propylene group, x and y is an integer of 1 or more, and an average value of x+y is 2 to 10, with at least a diol component and a carboxylic acid component selected from the group consisting of a di- or more-basic carboxylic acid or carboxylic anhydride and a lower alkyl ester of carboxylic acid, as exemplified by fumaric acid, maleic acid, maleic anhydride, phthalic acid, terephthalic acid, trimellitic acid, and pyromellitic acid.

A carrier to be used in combination with the toner in a developing unit includes, for example, metals such as iron, nickel, copper, zinc, cobalt, manganese, chromium and rare earth elements, whose particle surfaces may be oxidized or unoxidized, alloys or oxides of these metals, and ferrites. Particle surfaces of these carriers may be optionally coated with resins or the like.

The carrier may have an average particle diameter of from 20 to 100 μm, preferably from 25 to 70 μm, and more preferably from 30 to 65 μm. In the case when a two-component developer is used by mixture with a toner, the toner may be mixed in an amount of from 2% by weight to 10% by weight, and preferably from 3% by weight to 8% by weight, as the toner concentration in the developer. Good results can usually be thereby obtained. A toner concentration less than 2% by weight may make image density too low to be practically usable. A toner concentration more than 10% by weight may result in an increase in fog or the scattering of toner inside the machine to shorten the lifetime of the developer.

A dye or pigment can be used as a coloring agent of the toner. The dye includes C.I. Direct Red 1, C. I. Direct Red 4, C. I. Acid Red 1, C. I. Basic Red 1, C.I. Mordant Red 30, C.I. Direct Blue 1, C.I. Direct Blue 2, C. I. Acid Blue 9, C. I. Acid Blue 15, C.I. Basic Blue 3, C.I. Basic Blue 5, and C.I. Mordant Blue 7.

The pigment includes carbon black, Naphthol Yellow S, Hanza Yellow G, Permanent Yellow NCG, Permanent Orange GTR, Pyrazolone Orange, Benzidine Orange G, Permanent Red 4R, Watchung Red calcium salt, Brilliant Carmine 3B, First Violet B, Methyl Violet Lake, Phthalocyanine Blue, First Sky Blue, and Indanthrene Blue BC.

Preferred are furnace black, dis-azo yellow, insoluble azo, and copper phthalocyanine, which are suited as the pigment; and basic dyes or oil-soluble dyes, as the dye.

Particularly preferred pigments are C.I. Pigment Yellow 17, C.I. Pigment Yellow 15, C.I. Pigment Yellow 13, C.I. Pigment Yellow 14, C.I. Pigment Yellow 12, C.I. Pigment Red 5, C.I. Pigment Red 3, C.I. Pigment Red 2, C.I. Pigment Red 6, C.I. Pigment Red 7, C.I. Pigment Blue 15, C.I. Pigment Blue 16, etc.

Particularly preferred dyes are C.I. Solvent Red 49, C.I. Solvent Red 52, C.I. Solvent Red 109, C.I. Basic Red 12, C.I. Basic Red 1, C.I. Basic Red 3b, etc.

The toner to be used in the present invention may be mixed with a charge controlling agent so that its negative charge characteristics can be stabilized. In such an instance, it is preferred to use a colorless or pale-color negative charge controlling agent which may not affect the tone of the toner. The negative charge controlling agent includes, for example, organic metal complexes such as a metal complex of an alkyl-substituted salicylic acid, as exemplified by a chromium complex or zinc complex of di-tert-butylsalicylic acid. In the instance where the negative charge controlling agent is mixed in the toner, it should be added in an amount of from 0.1 to 10 parts by weight, and preferably from 0.5 to 8 parts by weight, based on 100 parts by weight of the binder resin.

The flowability index of the toner can be measured by the following manner, using a powder tester (Type PT-D, manufactured by Hosokawa Mikuron K.K.). (Measured in an environment of 23° C., 60% RH.)

(1) The toner is left to stand for 12 hours in the measurement environment, and thereafter weighed precisely in an amount of 5.0 g.

(2) Sieves with 100 meshes (opening: 150 μm), 200 meshes (opening; 75 μm) and 400 meshes (opening: 38 μm) are laid on a vibration table one on top of another.

(3) The toner precisely weighed in an amount of 5.0 g is gently placed on the sieve of 100 meshes, and the sieves are vibrated for 15 seconds in a vibration amplitude of 1 mm.

(4) The toner remaining on each sieve is gently precisely weighed.

a. $$\frac{\text{Weight of toner remaining on 100 mesh sieve (g)}}{\text{Weight of toner (5 g)}} \times 100$$

b. $$\frac{\text{Weight of toner remaining on 200 mesh sieve (g)}}{\text{Weight of toner (5 g)}} \times 100 \times \frac{3}{5}$$

c. $$\frac{\text{Weight of toner remaining on 200 mesh sieve (g)}}{\text{Weight of toner (5 g)}} \times 100 \times \frac{1}{5}$$

From the above a, b and c, the flowability index (%)=a+b+c is determined.

The volume average particle diameter of the toner is measured in the following manner.

Using as a measuring apparatus a Coulter counter TA-II Type (manufactured by Coulter Electronics Inc.), an interface capable of outputting number average distribution and volume average distribution (manufactured by Nikkaki K.K.) and a CX-1 personal computer (manufactured by Canon Inc.) are connected. As an electrolytic solution used in the measurement, an aqueous 1% NaCl solution is prepared using first grade sodium chloride.

To carry out the measurement, 0.1 to 5 ml of a surface active agent (preferably an alkylbenzene sulfonate) as a dispersant is added in 100 to 150 ml of the above aqueous electrolytic solution, and then 0.5 to 50 mg of a sample to be measured is added.

The electrolytic solution in which the sample has been suspended is dispersed for about 1 minute to about 3 minutes using an ultrasonic dispersion machine, and the particle size distribution of particles of 2 to 40 μm is measured by means of the above Coulter counter TA-H Type, using a 100 μm aperture as an aperture. The volume average particle size distribution is thus determined.

Based on the resulting volume average particle size distribution, the volume average particle diameter is determined.

As described above, the toner kit of the present invention, comprises a container holding the toner having a flowability index of from 5 to 25%, has a superior ability to regulate the toner flow, and can eliminate the problems such as the flying of toner around a toner container or a copying apparatus, the air pollution due to toner dust, and the remaining of toner in a container, which may occur when a toner container is transferred or a toner is supplied.

EXAMPLES

The present invention will be described below in greater detail by giving examples (including preparation examples). In the following, "part(s)" is by weight unless particularly referred to.

Toner Preparation Example 1

| | |
|---|---|
| Polyester resin prepared by condensation of propoxylated bisphenol with fumaric acid | 100 parts |
| Chromium complex compound of 3,5-di-tert-butylsalicylic acid | 4 parts |
| C.I. Pigment Yellow 13 | 1.4 parts |
| C.I. Basic Red 1 | 1.8 parts |
| C.I. Pigment Blue 15 | 1.5 parts |

The above materials were provisionally mixed using a Henschel mixer, and then the mixture was melt-kneaded using a roll mill, at a temperature set to 110° C. After cooled, the kneaded product was crushed using a hammer mill to a size of about 1 to 2 mm, and then finely ground using a jet mill. The finely ground product was classified by means of a DS classifier to give a classified product (a toner) with a volume average particle diameter of 7.8 μm.

Figure 6:
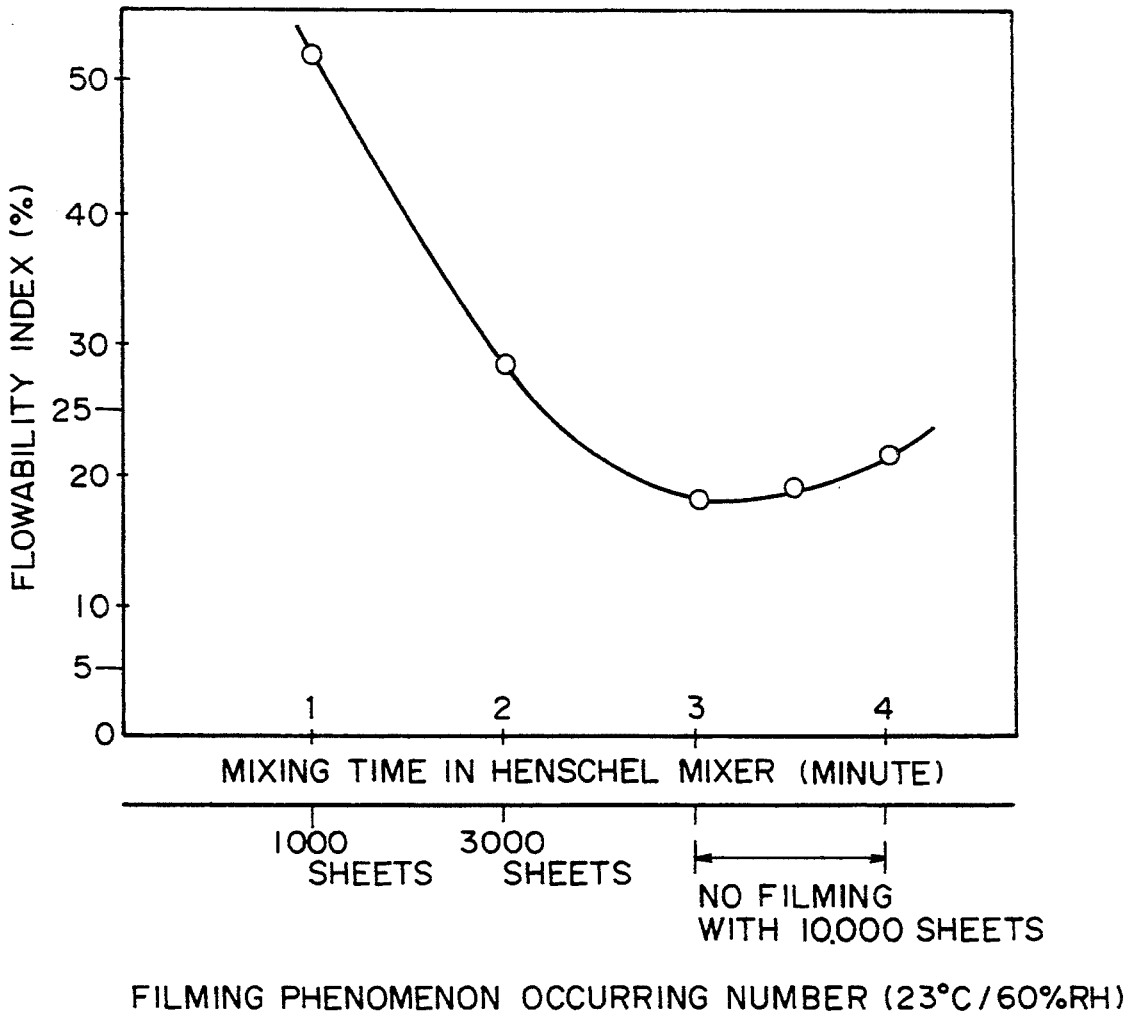
FIG. 6 is a graph to show the flowability index of a developer in an instance where a developer is prepared by mixing a toner and silica by means of a Henschel mixer, and the relationship between the frequency of occurrences of filming phenomenon occurring number in image reproduction tests and the flowability index of a developer.

In 1,000 parts of the above classified product, 7 parts of hydrophobic colloidal silica fine powder treated with a flowability improver hexamethyldisilazane was mixed and dispersed using a Henschel mixer to give a black toner with a flowability index of 18%, having hydrophobic colloidal silica on its toner particle surfaces. FIG. 6 shows the mixing time in a Henschel mixer, the flowability index, and the number of sheets of copy paper at which a filming phenomenon occurred when the developer prepared in the following manner was used.

As a carrier, ferrite particles of a Cu—Zn—Fe system were used as cores and a styrene/2-ethylhexyl acrylate/methyl methacrylate copolymer was used as a coat material.

In a tumbling shaker mixer T2C Type, 5 parts of the above toner having hydrophobic colloidal silica on its toner particle surfaces and 95 parts of the carrier were mixed to give a developer.

Using toners and developers obtained by changing the above mixing time, copies were taken by the use of a commercially available color electrophotographic copying machine (CLC-1, manufactured by Canon Inc.).

After copies were continuously taken on 10,000 sheets of paper, the surface of the photosensitive member was observed with an optical microscope to examine whether or not a filming phenomenon had occurred.

Toner Preparation Example 2

A cyan toner was prepared in the same manner as in Toner Preparation Example 1, except that 5 parts of C.I. Pigment Blue 15 was used as a coloring agent. In a Henschel mixer, 0.6 part of hydrophobic colloidal silica fine powder treated with a flowability improver dimethyldichlorosilane previously disintegrated using a pulverizer was mixed and dispersed in 100 parts of a classified product with a volume average particle diameter of 8.2 μm. A cyan toner with a flowability index of 15% was thus obtained.

Toner Preparation Example 3

| | |
|---|---|
| C.I. Pigment Red 122 | 4.0 parts |
| C.I. Solvent Red 49 | 1.0 part |

Except for using the above coloring agents, Toner Preparation Example 1 was repeated to give a magenta toner with a volume average particle diameter of 8.0 μm and a flowability index of 13%.

Comparative Toner Preparation Example 1

In Toner Preparation Example 1, the mixing time for mixing and dispersing the flowability improver by means of a Henschel mixer was shortened to 1 minute. As a result, a toner with a flowability index of 52% was obtained.

A developer was prepared and copies were taken according to the procedure in Example 1. As a result, white lines appeared on the image area in the peripheral direction of the photosensitive drum, after continuous copying on 1,000 sheets of paper. The photosensitive drum was observed with an optical microscope to confirm that a filming phenomenon was seen.

Effects on the discharge performance achieved by the combination of the toner obtained in the above preparation examples with the toner container of the present invention will be described below by giving examples and comparative examples.

Example 1

A toner container having the structure as shown in FIGS. 1, 2A, 2B and 3 was used. The slope angle $\theta$ of the flow control edge was 118°. The body 1 and the discharge opening member 5 were integrally formed of a styrene/butadiene copolymer. The discharge opening member 5 (43 mm×108 mm), having an area of 4,644 mm$^2$), had three discharge openings 4 of 17 mm×34 mm each (area: 578 mm$^2$). A sealing member made of polyurethane was adhered to the surface of the discharge opening member 5. The shutter member 3, formed of an ABS resin, had two openings 4*a* of 17 mm×31 mm each, and fitted to the discharge opening member 5 through the fitting member 8 made of polypropylene. The fitting member 8 had three openings 4*b* of 19 mm×32 mm each.

The discharge opening member 5 was provided with two flow control edges of 22 mm high, 40 mm long and 17 mm wide each. The slope 7 had dimensions of 20 mm×40 mm, and the wall surface 6 had dimensions of 7 mm×40 mm.

The body 1 was 200 mm high, 100 to 300 mm long and 48 to 55 mm wide.

The black toner (400 g) obtained in Toner Preparation Example 1 was put in the above toner container in a fill of 60%, and toner discharge tests were carried out under the following conditions.

The toner container was filled with 400 g of the toner. The container was vibrated for about 10 minutes using a vibrator. This was done on the assumption that the toner may have been agglomerated or become tight after it has been left to stand for a long period of time as it is held in the container, or as a result of transportation.

Subsequently, the container was gently dropped 10 times from a height of about 10 cm, and further rolled by 180° with repetition of 10 times. This operation is carried out before the toner is discharged. This was done taking account of the effect of loosening the toner in the container untight. Thereafter, the shutter member 3 of the container was pulled so that the toner held therein was discharged out of the container, and the time taken for the discharging was measured.

For the purpose of practical machine tests, the toner kit was fitted on a full-color electrophotographic copying machine (CLC-200, manufactured by Canon Inc.), and the state of the toner being discharged was observed.

In Example 1, the discharge time in which the toner was entirely discharged was 23 seconds. In the practical machine tests carried out by fitting the toner kit of Example 1 on the electrophotographic copying machine, the toner was rapidly introduced into the body of the copying machine without spouting and also the toner did not contaminate the inside of the machine..

Examples 2 to 5 and Comparative Examples 1 and 2, as shown below in Table 1, were also carried out in the same manner as in Example 1. Results obtained are shown together in Table 1.

TABLE 1

| | Toner | Toner flowability index (%) | (I) Angle $\theta$ (°C.) | Discharge time (sec.) | Discharge test: Remaining toner (%) | Practical machine test. Discharge performance | (II) |
|---|---|---|---|---|---|---|---|
| Example: | | | | | | | |
| 1 | Black toner* | 18 | 118 | 23 | 0 | Good | None |
| 2 | " | 18 | 130 | 32 | 0 | Good | None |
| 3 | Cyan toner** | 15 | 123 | 25 | 0 | Good | None |
| 4 | Magenta toner*** | 13 | 148 | 29 | 0 | Good | None |
| 5 | " | 13 | 115 | 14 | 0 | Slightly spouted | None |

TABLE 1-continued

| | Toner | Toner flowability index (%) | (I) Angle θ (°C.) | Discharge time (sec.) | Discharge test: Remaining toner (%) | Practical machine test. Discharge performance | (II) |
|---|---|---|---|---|---|---|---|
| Comparative Example: | | | | | | | |
| 1 | Black toner* | 18 | 167 | 49 | About 30% toner caused bridging around discharge openings. | Poor. Toner remains considerably. | None |
| 1 | Black toner**** | 52 | 120 | About 60% toner was not discharged even after one minute. | | — | — |

*prepared in Toner Preparation Example 1
**prepared in Toner Preparation Example 2
***prepared in Toner Preparation Example 3
****prepared in Comparative Toner Preparation Example 1
(I) Angle formed between flow control edge and discharge member, see Remarks (1)
(II) Flying in machine, contamination around machine.
Remarks
(1): Flow control edges used in Examples 1, 2 and 3 and Comparative Examples 1 and 2 had the form shown in FIG. 4; and those used in Examples 4 and 5, FIG. 5.
(2): Toner containers were constructed as shown in FIG. 1.
(3): Toner was used in a fill of 400 g in every case so that results can be seen under the same condition.

What is claimed is:

1. A toner kit comprising:

a toner for developing an electrostatic image, wherein said toner has a volume average particle diameter from 5 to 10 μm, said toner being mixed with a hydrophobic colloidal silica fine powder and the resulting mixed toner has a flowability index from 5 to 25%; and a toner container for holding said toner, wherein said toner container includes a body provided with a discharge opening with a flow control edge at least part of which has a slope with a slope angle θfrom 110° to 160° with respect to the plane of the discharge opening and said toner container further includes a shutter member slidable with respect to the discharge opening, a fitting member for fitting said shutter member to said body of said toner container and a sealing member for sealing a joint provided at a position between said shutter member and said body of said toner container, said sealing member having an opening portion to allow the toner to flow through the discharge opening.

2. The toner kit according to claim 1, wherein said toner has a flowability index of from 10 to 23% and said flow control edge has a slope with a slope angle θof from 110° to 150°.

3. The toner kit according to claim 1, wherein said toner container has a plurality of flow control edges at discharge openings.

4. The toner kit according to claim 1, wherein the toner container is filled with said toner by not more than 80% of its capacity.

5. The toner kit according to claim 1, wherein the toner container is filled with said toner by not more than 70% of its capacity.

6. The toner kit according to claim 1, wherein the toner container is filled with said toner by 50 to 65% of its capacity.

7. The toner kit according to claim 1, wherein the toner container is provided with a flow control edge of from 30 to 60 mm in length, from 10 to 40 mm in height and from 10 to 25 mm in width.

8. The toner kit according to claim 1, wherein the toner container has a plurality of discharge openings each having an area of from 5×A/100 to 20×A/100 based on the area A ($mm^2$) of the discharge opening member.

9. The toner kit according to claim 1, wherein the toner container i) has a plurality of discharge openings each having an area of from 10×A/100 to 15×A/100 based on the area A ($mm^2$) of the discharge opening member, ii) has a plurality of flow control edges of from 30 to 60 mm in length, from 20 to 30 mm in height and from 15 to 20 mm in width each, and iii) is filled with a toner by 50 to 65% of its capacity, said toner having a flowability index of from 10 to 23% and mixed with hydrophobic colloidal silica fine powder.

10. The toner kit according to claim 9 wherein said body of said toner container is formed of a styrene copolymer, said discharge opening member is formed of a styrene copolymer, said flow control edge is formed of a styrene copolymer, said shutter member formed of an ABS resin or AS resin, and said fitting member is formed of a polypropylene; and said toner contains a polyester resin as a binder resin.

11. The toner kit according to claim 1, wherein said sealing member comprises an elastic material.

12. The toner kit according to claim 1, wherein said sealing member comprises a polyurethane.

13. A toner kit comprising:

a toner for developing an electrostatic image, wherein said toner has a flowability index from 5 to 25%; and a toner container for holding said toner, wherein said toner container includes a body provided with a discharge opening with a flow control edge at least part of which has a slope with a slope angle θfrom 110° to 160° with respect to the plane of the discharge opening and said toner container further includes a shutter member slidable with respect to the discharge opening, a fitting member for fitting said shutter member to said body of said toner container and a sealing member for sealing a joint provided at a position between said shutter member and said body of said toner container, said sealing member having an opening portion to allow the toner to flow through the discharge opening.

14. The toner kit according to claim 13, wherein said toner has a flowability index from 10 to 23% and said flow control edge has a slope with a slope angle $\theta$ of from 110° to 150°.

15. The toner kit according to claim 13, wherein said toner container has a plurality of flow control edges and discharge openings.

16. The toner kit according to claim 13, wherein said toner container is filled with said toner to not more than 80% of its capacity.

17. The toner kit according to claim 13, wherein said toner container is filled with said toner to not more than 70% of its capacity.

18. The toner kit according to claim 13, wherein said toner container is filled with said toner to 50 to 65% of its capacity.

19. The toner kit according to claim 13, wherein said toner container is provided with a flow control edge of from 30 to 60 mm in length, from 10 to 40 mm in height and from 10 to 25 mm in width.

20. The toner kit according to claim 13, wherein said toner container has a plurality of discharge openings located in a discharge opening portion of said toner container, each of the discharge openings having an area of from $5\times A/100$ to $20\times A/100$, where A is the area in units of $mm^2$ of the discharge opening portion.

21. The toner kit according to claim 13, wherein said toner container (i) has a plurality of discharge openings located in a discharge opening portion of said toner container, each of the discharge openings having an area of from $10\times A/100$ to $15\times A/100$, where A is the area in units of $mm^2$ of the discharge opening portion, ii) has a plurality of flow control edges that are each from 30 to 60 mm in length, from 20 to 30 mm in height and from 15 to 20 mm in width, and (iii) is filled with toner to 50 to 65% of its capacity, said toner having a flowability index of from 10 to 23% and being mixed with hydrophobic colloidal silica fine powder.

22. The toner kit according to claim 21, wherein said body of said toner container comprises a styrene copolymer, the discharge opening portion comprises a styrene copolymer, said flow control edge comprises a styrene copolymer, said shutter member comprises an ABS resin or an AS resin, and said fitting member comprises a polypropylene, and said toner contains a polyester resin as a binder resin.

23. The toner kit according to claim 13, wherein said sealing member comprises an elastic material.

24. The toner kit according to claim 13, wherein said sealing member comprises a polyurethane.

* * * * *

UNITED STATES PATENT AND TRADEMARK OFFICE

CERTIFICATE OF CORRECTION

PATENT NO. : 5,449,095 Page 1 of 4

DATED : September 12, 1995

INVENTOR(S) : Hiroyuki KOBAYASHI

It is certified that error appears in the above-indentified patent and that said Letters Patent is hereby corrected as shown below:

On the title page,

AT [57] - ABSTRACT:

Line 6, "θof" should read --θ of--.

COLUMN 1:

Line 24, "in" should read --by----;
Line 29, "ity;" should read --ity--;
Line 34, "manufactured" should read --can be manufactured--;
Line 37, "Since," should read --Since--;
Line 66, "is" should read --are--.

COLUMN 2:

Line 5, "are" should read --be--;
Line 58, "not" should be deleted.

UNITED STATES PATENT AND TRADEMARK OFFICE

CERTIFICATE OF CORRECTION

PATENT NO. : 5,449,095 Page 2 of 4

DATED : September 12, 1995

INVENTOR(S) : Hiroyuki KOBAYASHI

It is certified that error appears in the above-indentified patent and that said Letters Patent is hereby corrected as shown below:

COLUMN 5:

Line 16, "roll" should read --role--;
Line 32, "slope 7 is" should read --slope 7--.

COLUMN 7:

Line 24, "timethyl-" should read --trimethyl--;
Line 25, "timethylethoxysilane," should read --trimethylethoxysilane,--.

COLUMN 8:

Line 8, "styreneacrylate" should read --styrene-acrylate--;
Line 22, "is" should read --are--.

UNITED STATES PATENT AND TRADEMARK OFFICE

CERTIFICATE OF CORRECTION

PATENT NO. : 5,449,095 Page 3 of 4

DATED : September 12, 1995

INVENTOR(S) : Hiroyuki KOBAYASHI

It is certified that error appears in the above-indentified patent and that said Letters Patent is hereby corrected as shown below:

COLUMN 10:

Line 19, "flying" should read --scattering--.

COLUMN 12:

Line 50, "machine.." should read --machine--.

COLUMN 13:

Line 35, "θfrom" should read --θ from--;
Line 48, "θof" should read --θ of--.

COLUMN 14:

Line 37, "claim 9" should read --claim 9,--;
Line 41, "member formed" should read --member is formed--;
Line 56, "θfrom" should read --θ from--.

UNITED STATES PATENT AND TRADEMARK OFFICE

CERTIFICATE OF CORRECTION

PATENT NO. : 5,449,095 Page 4 of 4

DATED : September 12, 1995

INVENTOR(S) : Hiroyuki KOBAYASHI

It is certified that error appears in the above-indentified patent and that said Letters Patent is hereby corrected as shown below:

COLUMN 15:

Line 1, "θof" should read --θ of--.

COLUMN 16:

Line 6, "ii)" should read --(ii)--.

Signed and Sealed this

Fifth Day of March, 1996

*Attest:*

*Attesting Officer*

BRUCE LEHMAN

*Commissioner of Patents and Trademarks*